US005704935A

United States Patent [19]

Pahl et al.

[11] Patent Number: 5,704,935

[45] Date of Patent: Jan. 6, 1998

[54] APPLIANCE FOR EPILATING HAIR

[75] Inventors: Dietrich Pahl, Hofheim; Diethard Merz, Darmstadt, both of Germany

[73] Assignee: Braun Aktiengesellschaft, Frankfurt, Germany

[21] Appl. No.: 687,465

[22] PCT Filed: Feb. 25, 1995

[86] PCT No.: PCT/EP95/00694

§ 371 Date: Jul. 29, 1996

§ 102(e) Date: Jul. 29, 1996

[87] PCT Pub. No.: WO95/24840

PCT Pub. Date: Sep. 21, 1995

[30] Foreign Application Priority Data

Mar. 16, 1994 [DE] Germany ..... 44 08 809.4

[51] Int. Cl.[6] ..... A61B 17/41

[52] U.S. Cl. ..... 606/48

[58] Field of Search ..... 607/46, 42; 606/43, 606/48

[56] References Cited

U.S. PATENT DOCUMENTS 5,169,398 12/1992 Glaros ..... 606/43

FOREIGN PATENT DOCUMENTS

| | | |
|---|---|---|
| 0 348 862 | 1/1990 | European Pat. Off. . |
| 0 493 849 | 7/1992 | European Pat. Off. . |
| 2 153 191 | 5/1973 | France . |
| 2 430 239 | 2/1980 | France . |
| 6 621 827 | 4/1989 | France . |
| 2 646 779 | 11/1990 | France . |
| 39 22 949 | 9/1990 | Germany . |

OTHER PUBLICATIONS

Copy of International Search Report dated Jun. 21, 1995.

*Primary Examiner*—William E. Kamm

*Attorney, Agent, or Firm*—Fish & Richardson P.C.

[57] ABSTRACT

An appliance for epilating hair of the human skin includes an epilation head with at least two electrical conductors and a clamping device for gripping and plucking the hair. The electrical conductors at least temporarily engaging the skin during hair plucking. A casing is attached to the epilation head and a motor housed in the casing drives the clamping device to cause the clamping device to automatically and periodically perform its functions of gripping and plucking. A generator electrically connected to the electrical conductors provides a stimulator current to the skin when the electrical conductors are in contact with the skin so as to electrically stimulate the nerve system under the skin during hair plucking.

23 Claims, 2 Drawing Sheets

APPLIANCE FOR EPILATING HAIR

This invention relates to an appliance for epilating hair, in particular hair of the human skin, with a casing adapted to be held in the user's hand for accommodating a motor driving a clamping device provided in an epilation head of the appliance for gripping and plucking the hairs, with the clamping device being adapted to be guided over the skin to be treated.

A multiplicity of such appliances are already known from pertinent literature, and some of these appliances have proven to be successful in practical use. An appliance of this type is described, for example, in European Patent Application No. 0 147 285. Another appliance is known from German Patent Application No. DE 39 22 949 A1. Finally, a more recent further development of an epilating appliance is described in German Patent Application No. DE 43 09 406. The disclosure content of the aforementioned applications (filed by the same applicant) is included in the present application by express reference.

It is a general problem in these appliances to increase the efficiency of the hair plucking operation and reduce the user's feeling of pain as hair is removed. Although many attempts have been made in the past to increase the efficiency of these appliances and reduce the user's feeling of pain, the application of such appliances to the extraction of hair from the human skin is perceived extremely unpleasant by part of its users, some even rejecting this method of hair removal totally because of the great pain felt during use.

By contrast, it is an object of the present invention to improve upon a hair epilating appliance to the effect that the feeling of pain in the use of the appliances is reduced to the largest possible extent.

According to the present invention, this object is essentially accomplished in that the appliance includes at least two electrically conductive parts, in particular electrodes or the like, which during the hair plucking operation are movable into engagement with the skin together with the clamping device, that the appliance has a related generator producing a stimulator current, in particular a pulse generator or the like, and that the outputs of the generator are connected to the electrically conductive parts.

Accordingly, the present invention makes use of the effect of nerve stimulation by the application of a stimulator current, in particular of current pulses, to the skin, in order stimulate the nerve system under the skin, thereby alleviating or even eliminating the pain during the application of the hair epilating appliances. In use of the appliance, the electrically conductive parts make contact with the skin jointly with the clamping device, while a pulse generator or the like operates on the electrically conductive parts to apply current pulses to the skin to be treated. These current pulses electrically activate pain inhibitors that are present in the human organism, blocking in consequence the transmission of pain impulses produced by the extraction of the hairs. The action of the stimulator current on the skin results in a perceptible raise in the pain threshold produced by a release of morphine-like substances normally present in the body (endorphines). The intensity of the stimulator current is individually adjustable, so that the user senses a slight tingling, a vibration or the like in the area of the skin located between the electrodes. In any case, the user may adjust the stimulator current to a setting sufficiently low to prevent muscular contractions from being released. As practical tests have shown, extracting the hair while at the same time applying a stimulator current to the skin results in a distinctly perceptible reduction of the feeling of pain as the hairs are extracted.

In an advantageous further aspect, the generator is received in the casing and is connectible, in particular together with the motor, to a power supply, in particular the line voltage, or an a.c. voltage stepped down by a transformer, or a d.c. voltage of a rechargeable accumulator, a battery or the like. Because the generator is integrated into the appliance, the manipulating capability of the appliance is improved, and appliances equipped with a battery or a rechargeable accumulator may also be used independently of the line.

Advantageously, the generator is configured as an adjustable pulse generator with a pulse repetition frequency in the range of between 1 Hz and 500 Hz, a pulse duration of between 1 ms and 0.5 s, and a pulse amplitude of between 1 V and 100 V.

Preferably, the generator supplies alternating current or unipolar pulses, that is, a pulsating direct current, of an adjustable intensity varying between 0 and 200 mAs.

In an advantageous configuration of the present invention, the clamping device is configured as a rotary barrel, spiral or the like mounted in the epilation head and having a plurality of clamping elements movable in particular periodically and in pairs or groups toward and from each other, the curved surface of the barrel being adapted to be placed in contact with the skin.

In another advantageous embodiment, the clamping device is configured as a cylinder adapted to have its end surface in engagement with the skin, with the clamping elements, for example, the clamping jaws, being in particular periodically placeable against the cylinder shell. This provides in particular the possibility to configure the cylinder as a partial cylinder which is conducive to an effective gripping of the hairs, as described in the aforementioned prior art.

According to a greatly advantageous further aspect of the present invention, at least one electrically conductive part is configured as a roller, thereby improving the sliding as well as the guiding action of the epilation head on the skin to be treated.

In this arrangement, the axis of rotation of the roller is aligned essentially parallel to the axis of rotation of the barrel, spiral, or the like.

Advantageously, the electrically conductive parts are arranged laterally adjacent to that section of the clamping device that is to be placed in contact with the skin, lying in an approximately common plane with this particular section. During the extraction of hairs, this ensures that the electrodes are in permanent contact with the skin, and that the advantageous effect of the stimulator current comes to bear.

In another advantageous aspect of the present invention, the electrically conductive parts are secured to the epilation head in a common mounting structure.

By rotatably arranging the mounting structure on the epilation head, with the axis of rotation of the mounting structure being aligned essentially parallel to the axis of rotation of the barrel, spiral or the like, an increased flexibility in the manipulation of the appliance of the present invention is ensured, in addition to ensuring that the electrically conductive parts are at all times in engagement with the skin, also during tilting movements of the appliance relative to the skin sections to be treated.

A particularly advantageous action of the electrically conductive parts during tilting movements of the appliance results if the axis of rotation of the mounting structure is substantially identical with the axis of rotation of the barrel, spiral or the like.

In another embodiment of the present invention, the electrically conductive parts are configured as skids or the like and are arranged laterally adjacent to that section of the clamping device that is to be placed in contact with the skin.

By mounting the electrically conductive parts resiliently on the epilation head, permanent contact of the electrically conductive parts with the skin is ensured also in the treatment of more distinctly curved sections of the skin.

In still another embodiment of the present invention, the electrodes are advantageously made of a flexible material as, for example, conducting rubber, conducting plastics or the like, thereby ensuring a plane engagement of the conducting parts with curved sections of the skin surface.

In yet another greatly advantageous embodiment of the present invention, the clamping elements themselves are configured as electrically conductive parts and are connected to the generator.

In this arrangement, the clamping location of the clamping elements is advantageously made of an electrically non-conducting material or is provided with a non-conducting coating.

In another embodiment, the cylinder of the clamping device is encompassed by a further cylinder, ring or the like, with the outputs of the generator being connected to the cylinder and to the further cylinder, ring or the like.

However, the possibility also exists to connect the outputs of the generator to a clamping jaw of the clamping device and to the cylinder, in which arrangement, as described in the foregoing, a short circuit of the generator on relative clamping contact of the clamping elements is avoidable by the application of a suitable, electrically non-conducting coating to the clamping device.

In another advantageous embodiment of the present invention, one or several switches and/or rotary controls or the like are provided on the casing for individual adjustment of the generator parameters by the user, with preferably the intensity and/or pulse repetition frequency parameters being variable.

In another independent embodiment of the present invention, the epilation head includes fluid-applying means as, for example, a sponge, a brush, a metering container or the like. With these means, the sections of the skin located between the electrically conductive parts can be slightly wetted, thus reducing the contact resistance between the electrodes and the skin and/or increasing the conductivity of the skin. In consequence, low-intensity stimulator currents completely safe for the user are sufficient to raise the pain threshold significantly.

Further features, advantages and application possibilities of the present invention will become apparent from the subsequent description of embodiments illustrated in more detail in the accompanying drawings. It will be understood that any single feature and any combination of single features described and/or represented by illustration form the subject-matter of the present invention, irrespective of their summarization in the claims and their back-references.

Figure 1:
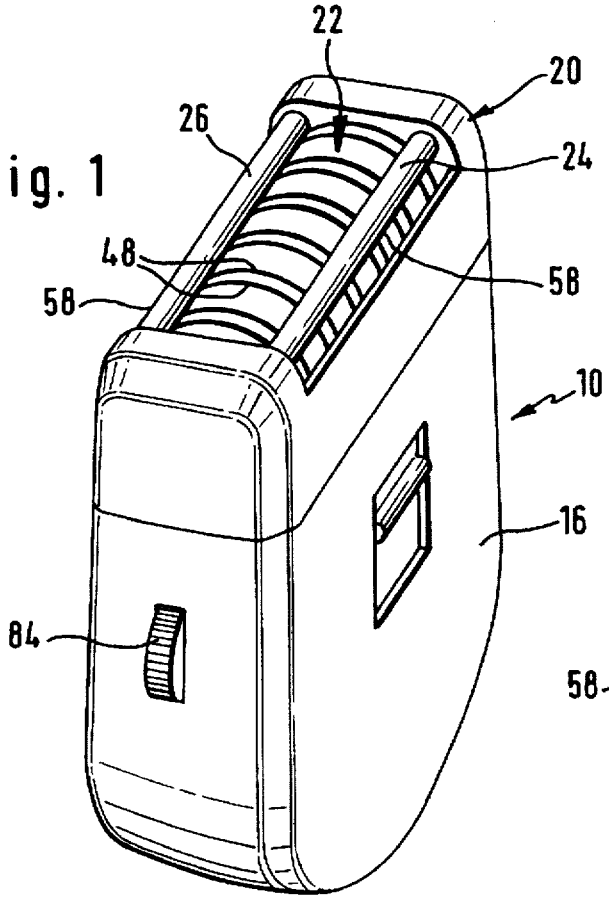
FIG. 1 is a general view of an appliance constructed in accordance with the present invention.

The appliance 10 for epilating hairs 12 from the human skin 14 includes a casing 16 adapted to be held in the user's hand and receiving therein a motor 18. The motor 18 is in driving connection with a clamping device 22 disposed in an epilation head 20. The clamping device 22 comprises a clamping system operating in the manner of tweezers for gripping and plucking the hairs 12. For treatment, the appliance with the clamping device 22 is movable in a guiding motion toward and over the skin 14 to be epilated.

In the area of the epilation head 20 and laterally adjacent to the clamping device 22, the appliance 10 possesses at least two electrically conductive parts 24, 26, 28, 30, 32, 34, 36, in particular electrodes or the like, which, for plucking the hairs 12, are movable into engagement with the skin 14 together with the clamping device 22.

Further, the appliance 10 includes a generator 38 received in particular in the casing 16 and producing a stimulator current for effecting a raise in the pain threshold. The generator 38 is in particular configured as a pulse generator, the outputs 40, 42 of the generator 38 being connected to the electrically conductive parts 24 to 36.

Figure 2:
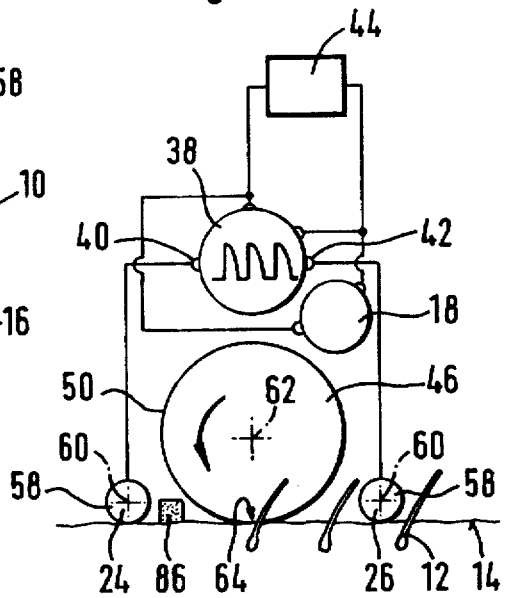
FIG. 2 is a schematic representation of the mode of function of the appliance of the present invention.

As becomes apparent particularly from FIG. 2, the generator 38 and the motor 18 are jointly connected to a power supply 44 of the appliance 10. Suitable supply voltages are in particular the line voltage or, alternatively, a d.c. voltage of a rechargeable accumulator, a battery or the like. In the latter case, the appliance 10 can be operated independently of the line, eliminating the inconvenience of a power cord between the appliance 10 and the power supply when the appliance 10 is being used.

The generator 38 is configured as an adjustable pulse generator, with the pulse repetition frequency being variable in a range of between 1 Hz and 500 Hz, approximately, the pulse duration between 1 ms and 0.5 s, approximately, and the pulse amplitude being variable between 1 V and 100 V, approximately. The generator 38 produces alternating current or a pulsating direct current or unipolar pulses, that is, a pulsating direct current, of an adjustable intensity in the range of between 0 and 200 mAs, approximately.

According to the embodiments of FIG. 1 to 4, the clamping device 22 is configured as a rotary barrel 46, spiral or the like mounted in the epilation head 20 and having a plurality of clamping elements 48. The clamping elements 48 are movable periodically and in pairs or groups toward and from each other. With its curved surface 50, the barrel 46, spiral or the like is adapted to be placed in contact with the skin 14 for treatment of the skin 14.

Figure 5:
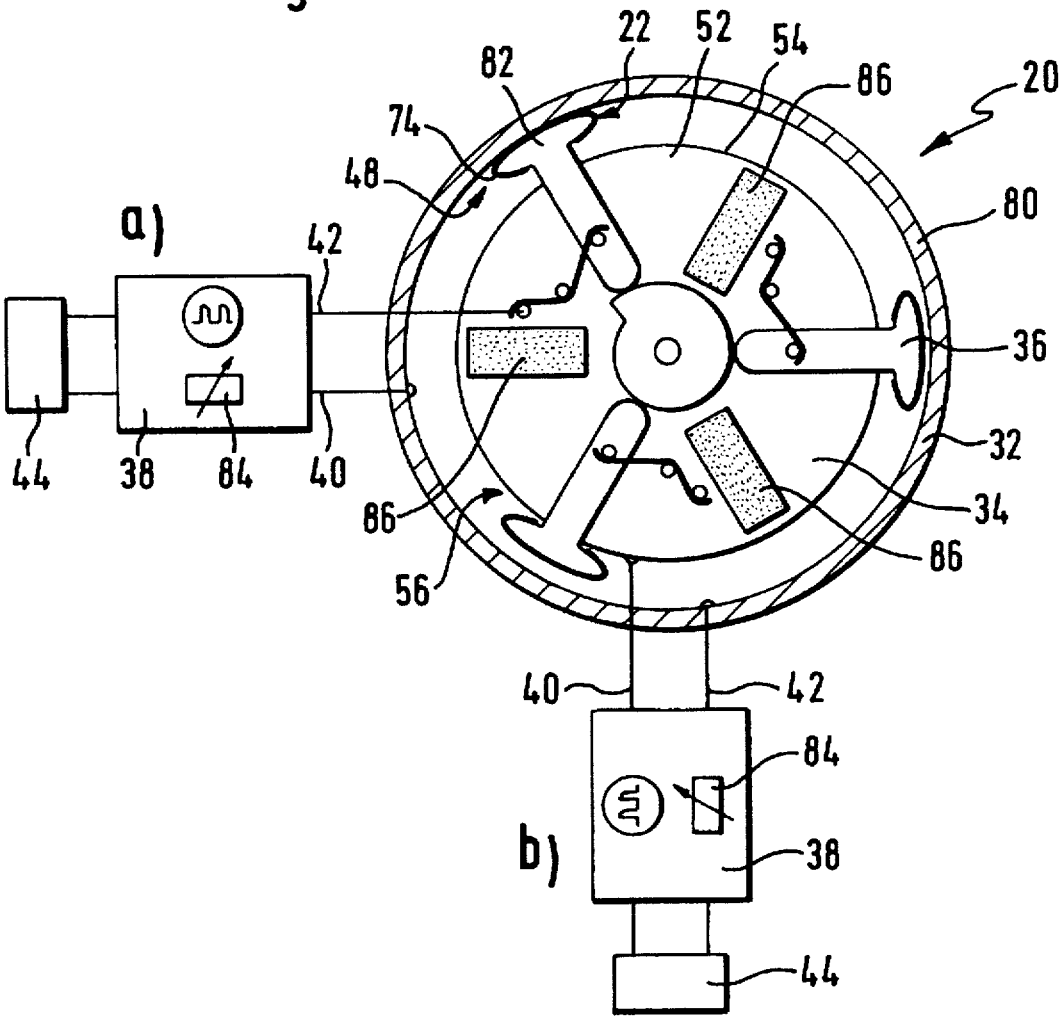
FIG. 5 is a schematic representation of a particular third embodiment of the present invention.

According to the embodiment of FIG. 5, the clamping device 22 is configured as a cylinder 52 adapted to have its end surface 56 in engagement with the skin 14, with the clamping elements 48, which are configured as clamping jaws 82, being in particular periodically placeable against the shell 54 of the cylinder 52.

Advantageously, the electrically conductive parts 24, 26 are configured as rollers 58. In this arrangement, the axes of rotation 60 of the rollers 58 are aligned essentially parallel to the axis of rotation 62 of the barrel 46, the spiral, or the like. The electrically conductive parts 24 to 36 are arranged laterally adjacent to that section 64 of the clamping device 22 that is to be placed in contact with the skin 14, lying in an approximately common plane with that section 64.

Figure 3:
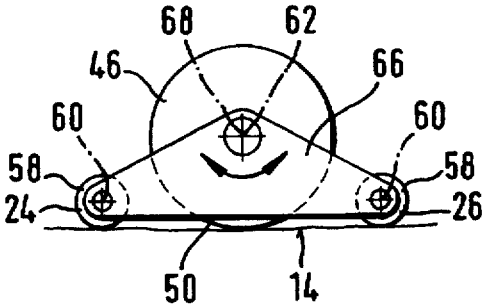
FIG. 3 is a schematic representation of a particular first embodiment of the present invention.

According to FIG. 3, the electrically conductive parts 24, 26, in particular the rollers 58, are secured to the epilation head 20 in a common mounting structure 66. The mounting structure 66 is rotatably arranged on the epilation head 20, with the axis of rotation 68 of the mounting structure 66 being aligned essentially parallel to the axis of rotation 62 of the barrel 46, spiral or the like. In the embodiment of FIG. 3, the axis of rotation 68 of the mounting structure 66 is essentially identical with the axis of rotation 62 of the barrel 46, spiral or the like.

Figure 4:
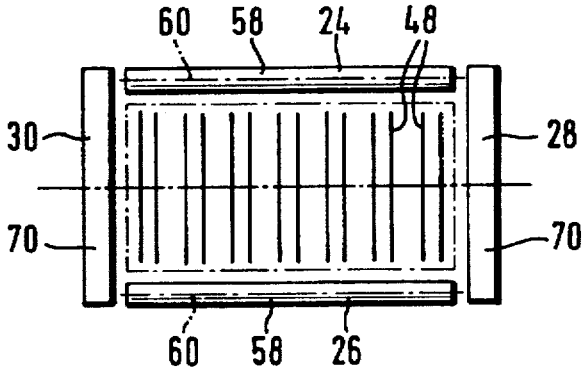
FIG. 4 is a schematic representation of a particular second embodiment of the present invention.

As illustrated in FIG. 4, the electrically conductive parts 28, 30 are configured as skids 70 or the like, and are arranged laterally adjacent to that section 64 of the clamping device 22 that is to be placed in contact with the skin 14.

It is noted that the skids 70 per se are sufficient for the application of the stimulator current to or on the skin. Under circumstances, however, the added provision of the rollers 58 on the epilation head 20 may be convenient, the rollers 58 and skids 70 then being jointly connected in pairs to a single generator 38, or each separately to two generators 38 or two channels of a single generator 38.

In this arrangement, it is an advantage that the electrically conductive parts 24 to 36 are mounted on the epilation head 20 resiliently. Another alternative provides making the electrically conductive parts 24 to 36 of a flexible material as, for example, conducting rubber, conducting plastics or the like.

Figure 6:
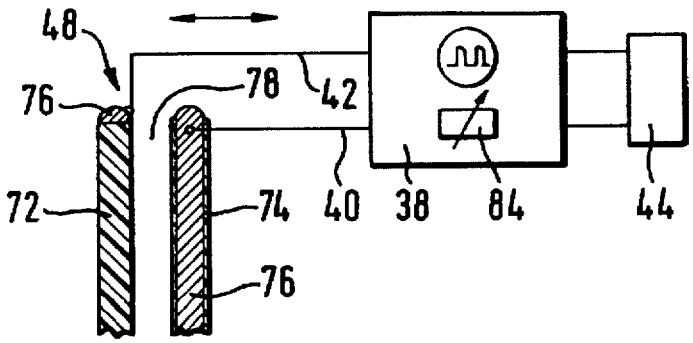
FIG. 6 is a schematic representation of a particular fourth embodiment of the present invention.

As becomes apparent from FIGS. 5 and 6, the clamping elements 48 are configured as electrically conductive parts 24 to 36 and connected to the generator 38. In this embodiment, the clamping location 78 of the clamping elements 48 is made of an electrically non-conducting material 72 or is provided with a non-conducting coating 74. At the location where the clamping elements 48 make contact with the skin 14, electrically conducting material 76 is provided which is in connection with the outputs 40, 42 of the generator 38.

According to FIG. 5, the cylinder 52 is encompassed by a further cylinder, ring 80 or the like, with the outputs 40, 42 of the generator 38 being connected to the cylinder 52 and the further cylinder, ring 80 or the like (FIG. 5*b*).

Further, the possibility also exists to connect the outputs 40, 42 of the generator 38 to a clamping jaw 82 and to the cylinder 52 or to the further cylinder, ring 80 or the like (FIG. 5*a*).

In either case of the FIG. 5, the provision of, for example, an electrically non-conducting coating 74 applied to the clamping jaw 82 is necessary to prevent short-circuiting of the generator 38 during the clamping operation.

All electrical contacts between the outputs 40, 42 of the generator 38 and the electrically conductive parts 24 to 36 which, if applicable, are movable, may be implemented in the conventional manner as, for example, by means of sliding-action contacts, sliprings, rotary joints, or the like.

Provided on the casing 16 are rotary controls 84 or the like for individual adjustment of the parameters of the generator 38 by the user, with preferably the intensity and/or pulse repetition frequency parameters being variable.

It has proven to be a great advantage to slightly wet the skin 14 prior to treatment, because this makes it possible to reduce the contact resistance between the electrodes and the skin and/or the conductivity of the skin, and to enhance the effect of the stimulator current or reduce the intensity of the stimulator current as compared to the treatment of dry skin. For wetting the skin, the epilation head 20 includes fluid-applying means 86 as, for example, a sponge, a brush, a metering container or the like. The fluid may be tap water or, alternatively, water enriched with salts, special moisturizing emulsions, moisturizing creams or the like.

It will be understood that the embodiments of the present invention described in the foregoing are merely intended for purposes of explanation, without however limiting the invention to these particular embodiments. Essential for the invention is the arrangement that operates to reduce the pain felt in the mechanical removal of hairs from the human skin by means of motor-powered clamping devices, by the simultaneous application of a stimulator current to the particular skin section to be treated.

We claim:

1. An appliance for epilating hair from skin, said appliance comprising:

an epilation head including at least two electrical conductors and a clamping device for gripping and plucking the hair, the electrical conductors at least temporarily engaging the skin during hair plucking, a casing attached to the epilation head, a motor housed in the casing for driving the clamping device to cause the clamping device to automatically and periodically perform its functions of gripping and plucking, and a generator electrically connected to the electrical conductors for providing a stimulator current to the skin when the electrical conductors are in contact with the skin so as to electrically stimulate the nerve system-under the skin during hair plucking.

2. The appliance of claim 1 wherein the clamping device comprises a plurality of clamping elements for gripping and plucking the hairs.

3. The appliance of claim 2 further comprising a control located on the casing for permitting adjustment of the generator by the user.

4. The appliance of claim 1 wherein the casing houses the generator, the motor and generator being configured to be jointly connected to a power supply.

5. The appliance of claim 1 wherein the generator comprises an adjustable pulse generator having a pulse repetition frequency in the range of about 1 to 500 Hz, a pulse duration in the range of about 1 ms to 0.5 s, and a pulse amplitude in the range of about 1 V to 100 V.

6. The appliance of claim 1 wherein the generator supplies unipolar pulses of an adjustable intensity varying between about 0 and 200 mA.

7. The appliance of claim 1 wherein the generator supplies alternating current of an adjustable intensity varying between about 0 and 200 mA.

8. The appliance of claim 1 wherein said electrical conductors are arranged laterally adjacent and substantially in a common plane with a skin contacting part of the clamping device.

9. The appliance of claim 8 further comprising a common mounting structure for mounting the electrical conductors to the epilation head.

10. The appliance of claim 9 wherein the mounting structure is rotatably connected to the epilation head with an axis of rotation of the mounting structure aligned substantially parallel to an axis of rotation of the rotating member.

11. The appliance of claim 10 wherein the axis of rotation of the mounting structure is identical to the axis of rotation of the rotating member.

12. The appliance of claim 1 wherein the clamping device comprises a rotating member and a plurality of clamping elements located on an outer curved surface of the rotating member, the clamping elements being movable periodically and in pairs toward and away from each other, the curved surface of the barrel configured for placement in contact with the skin.

13. The appliance of claim 12 wherein the electrical conductors each comprise a roller.

14. The appliance of claim 13 wherein an axis of rotation of each roller is aligned substantially, parallel with an axis of rotation of the rotating member.

15. The appliance of claim 1 wherein the electric conductors comprise skids.

16. The appliance of claim 1 wherein the electrical conductors are resiliently mounted to the epilation head.

17. The appliance of claim 1 wherein the electrical conductors are made of flexible material.

18. The appliance of claim 1 wherein the clamping device comprises an inner cylinder, an outer shell, and a plurality of clamping elements, the cylinder having an end surface for placement in contact with the skin and the clamping elements being periodically placeable against the outer shell.

19. The appliance of claim 18 wherein a non-clamping portion of the clamping elements comprise the electrical conductors.

20. The appliance of claim 19 wherein a clamping location of the clamping elements is non-conductive.

21. The appliance of claim 18 wherein the generator is connected to the inner cylinder and the outer shell.

22. The appliance of claim 18 wherein the generator has two outputs and one of the outputs is connected to the clamping elements.

23. The appliance of claim 1 wherein the epilation head further includes a fluid applicator.

* * * * *